US005994605A

United States Patent [19]

Bak et al.

[11] Patent Number: 5,994,605

[45] Date of Patent: Nov. 30, 1999

[54] HIGH VISCOSITY POLYALPHAOLEFINS

[75] Inventors: Russell J. Bak, Spring; Barrett L. Cupples, Kingwood, both of Tex.

[73] Assignee: Chevron Chemical Company, San Ramon, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/759,766

[22] Filed: Dec. 3, 1996

[51] Int. Cl.[6] ..... C07C 2/02

[52] U.S. Cl. ..... 585/525; 585/520; 585/521

[58] Field of Search ..... 585/520, 525, 585/521

[56] References Cited

U.S. PATENT DOCUMENTS

| | | | |
|---|---|---|---|
| 4,409,415 | 10/1983 | Morganson et al. | 585/525 |
| 4,417,082 | 11/1983 | Larkin et al. | 585/10 |
| 4,434,309 | 2/1984 | Larkin et al. | 585/10 |
| 4,587,368 | 5/1986 | Pratt | 585/12 |
| 4,650,917 | 3/1987 | Dessau et al. | 585/329 |
| 4,902,846 | 2/1990 | DiLeo et al. | 585/525 |
| 4,956,512 | 9/1990 | Nissfolk et al. | 585/521 |
| 4,982,026 | 1/1991 | Karn et al. | 585/18 |
| 4,982,042 | 1/1991 | Akatsu et al. | 585/510 |
| 5,068,487 | 11/1991 | Theriot | 585/510 |
| 5,191,140 | 3/1993 | Akatsu et al. | 585/525 |
| 5,510,392 | 4/1996 | Feuston et al. | 514/772.3 |
| 5,514,761 | 5/1996 | Etherton et al. | 526/144 |
| 5,516,958 | 5/1996 | Schaerfl, Jr. et al. | 585/522 |

FOREIGN PATENT DOCUMENTS

| | | |
|---|---|---|
| 497206A2 | 8/1992 | European Pat. Off. . |
| 2420661 | 11/1974 | Germany . |
| 53-132503 | 11/1978 | Japan . |

*Primary Examiner*—Walter D. Griffin
*Assistant Examiner*—Thuan D. Dang
*Attorney, Agent, or Firm*—W. Bradley Haymond

[57] ABSTRACT

A synthetic lubricant material is produced by forming a catalyst complex of a boron trifluoride catalyst and at least one alcohol promoter in the absence of olefinic monomer, then oligomerizing a $C_{4-16}$ olefinic monomer by adding the olefinic monomer to a reaction vessel containing the catalyst complex, under boron trifluoride pressure, to produce an oligomer product. At least 50 weight % of the olefinic monomer is $C_{8-16}$ olefinic monomer.

4 Claims, 1 Drawing Sheet

HIGH VISCOSITY POLYALPHAOLEFINS

The present invention relates to a process for producing polyalphaolefins that maximizes the degree of oligomerization, with good conversion and product quality.

BACKGROUND OF THE INVENTION

It is well known to make polyalphaolefins by admixing an olefinic feed (1-hexene to 1-hexadecene) with a promoter and a catalyst, such as boron trifluoride ($BF_3$), under mild pressure/temperature conditions. Polyalphaolefin product limitations, such as 100° C. viscosity of less than 10 centistoke and oligomer distribution focused on the tetramer-hexamer fraction, arise from the use of the aforementioned processes. In general, higher viscosity fluids (100° C. viscosity of greater than 10 centistoke) can only be made with a severe production rate penalty, since longer residence times are required to achieve the target viscosity with current technology.

U.S. Pat. No. 4,587,368 to Pratt et al. discloses the oligomerization of 1-alpha olefin in two stages to yield a mixture low in trimer and high in tetramer and higher oligomers. In the first stage, a $C_{8-12}$ 1-alpha olefin is oligomerised in a conventional process until the monomer is totally reacted. During that first stage, a BF3:promoter complex is formed. In the second stage, an aliquot of monomer is added and the reaction is allowed to go to completion. The final process yields a product viscosity of approximately 8 centistoke.

U.S. Pat. No. 4,982,026 to Karn et al. discloses highly reactive polymers obtained from low carbon number monomers. The process involves the preparation of a mixture of hexane solvent, phosphoric acid, and a catalyst substrate; cooling of mixture to −20° C., and saturating the mixture with $BF_3$ to form the catalyst complex. Propylene gas and $BF_3$ are then added to complex until the reaction is completed (Example 1). In Example 2, a silica gel is used as a catalyst substrate with hexane solvent and phosphoric acid:$BF_3$ complex components. Notice that the catalyst complex is a $BF_3$:acid complex, not a $BF_3$:alcohol complex. The process yields polymers with mole weights of from 250 to 500, having a high degree of mono-unsaturation content.

U.S. Pat. No. 4,650,917 to Dessau et al. discloses Viscosity Index improvers for synthetic lubricants produced by olefin oligomerization of olefin monomers by contact with $BF_3$ solid acidic catalyst. The catalyst complex is a $BF_3$:silica complex, not a $BF_3$:alcohol complex. The Example describes the oligomerization of propylene over a $BF_3$-containing acidic resin catalyst and the subsequent isomerization of lube fraction by contact with an unbound hydrogen exchange zeolite.

U.S. Pat. No. 4,434,309 to Larkin et al. discloses the oligomerization of low molecular weight alpha olefins over a $BF_3$ protonic promoter complex. Specifically, Example 10 describes the introduction of an alpha-olefin mixture to complex of $BF_3$, 1-butanol, and cyclohexane, and the production low molecular weight synthetic lubricants. It appears that, in the examples using a $BF_3$ protonic promoter complex, the oligomerization does not occur under boron trifluoride pressure.

U.S. Pat. No. 5,510,392 to Feuston et al. discloses the oligomerization of alpha olefins with a $BF_3$:promoter complex. The alpha olefins and the $BF_3$:promoter complex are added simultaneously to the reactor. The final product has a 100° C. viscosity of 5.2 centistoke.

U.S. Pat. Nos. 4,434,309, 4,587,368, 4,650,917, 4,982,026, and 5,510,392 are hereby incorporated by reference for all purposes.

SUMMARY OF THE INVENTION

The present invention provides a process for producing a high degree of olefin oligomerization not yet recognized by practitioners of the art. We have found that the oligomer distribution can be radically changed towards heavier (octamer) oligomers by introducing the olefinic feed into a pool of in situ formed alcohol:$BF_3$ complex. Moreover, we have found that the longer straight-chained alcohols produce a heavier product viscosity. The addition of an alpha-omega diolefin as a co-monomer produces yet another significant product viscosity increase over and above that achieved in the present invention.

The synthetic lubricant material is produced by two step process. In the first step, a catalyst complex of a boron trifluoride catalyst and at least one alcohol promoter is formed in the absence of olefinic monomer. In the second step, a $C_{4-16}$ olefinic monomer is oligomerized by adding the olefinic monomer to a reaction vessel containing the catalyst complex, under boron trifluoride pressure, to produce an oligomer product, wherein the olefinic monomer comprises at least 50 weight % $C_{8-16}$ olefinic monomer.

The $C_{4-16}$ olefinic monomer can comprise an alpha-omega diolefin. Preferably, the alpha-omega diolefin constitutes from 2 to 50 weight % of the $C_{4-16}$ olefinic monomer.

Preferably, the alcohol promoter used in the catalyst complex comprises a straight-chain mono-alcohol having from four to twelve carbon atoms.

The raw oligomer product produced by this process has less than 10 weight % dimer and trimer, less than 75 weight % tetramer through heptamer, and at least 15 weight % octamer and higher oligomers.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE INVENTION

Figure 1:
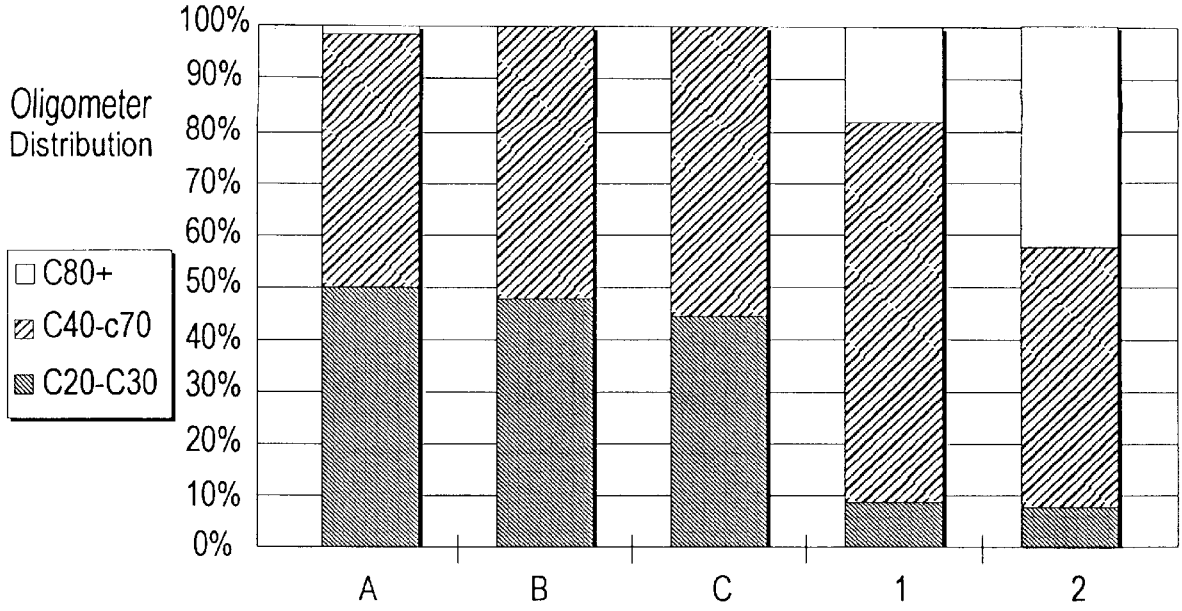
FIG. 1 compares the oligomer distribution of examples in Table 1. Notice the relative percentages of $C_{20}$–$C_{30}$ and $C_{80+}$. In Examples 1 and 2 the weight percent of $C_{20}$–$C_{30}$ oligomers declines dramatically, while $C_{80+}$ oligomers increase significantly. This is the characteristic of the present invention, minor amount of $C_{20}$–$C_{30}$ and increasing octamer and higher oligomers.
Figure 2:
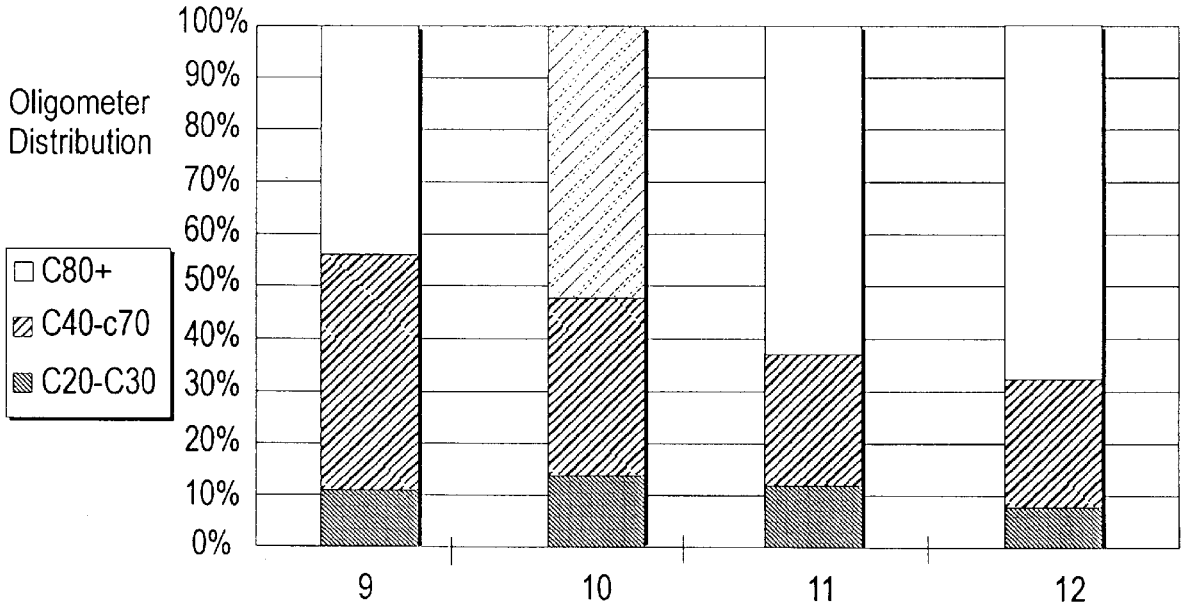
FIG. 2 shows the effect of 1,9-decadiene on the oligomer distribution using the present invention (Examples 10–12). The 1,9-decadiene significantly increases the percentage of $C_{80+}$ (octamer) oligomers in the product and thus dramatically increases the product viscosity (see Table 3).

In its broadest aspect, the present invention involves a process for producing a synthetic lubricant material by forming a catalyst complex of a boron trifluoride catalyst and at least one alcohol promoter in the absence of olefinic monomer; then oligomerizing an olefinic monomer by contacting it with the catalyst complex, under boron trifluoride pressure, to produce an oligomer product.

Olefinic Monomer

By "olefinic monomer," we mean either an olefin or mixture of olefins having from four to sixteen carbon atoms. At least 50 weight % of the olefinic monomer comprises $C_{8-16}$ olefinic monomer.

Preferably, olefins used in making the oligomer are predominately (at least 50 mole %) straight-chain, mono-olefinically unsaturated hydrocarbons in which the olefinic unsaturation occurs at the 1- or α-position of the straight carbon chain. Straight-chain α-olefins are preferred because they are more reactive, commercially available, and make products having higher viscosity indexes. Such α-olefins can be made by the thermal cracking of paraffinic hydrocarbons or by the well known Ziegler catalized ethylene chain growth and displacement on triethyl aluminum. Individual olefins may be used, as well as mixtures of such olefins. Examples of such olefins are 1-hexene, 1-heptene, 1-octene, 1-nonene, 1-decene, 1-undecene, 1-dodecene, 1-tetradecene, and 1-hexadecene. The more preferred normal α-olefin monomers are those containing about 8 to 14 carbon atoms.

In one embodiment, the olefin monomers also contain from 2 to 50 weight % of an alpha-omega diolefin, such as 1,5-hexadiene, 1,6-heptadiene, 1,7-octadiene, 1,8-nonadiene, and 1,9-decadiene. Most preferably, the olefin monomer contains 2 weight % 1,9-decadiene. The preparation of alpha-omega diolefins is disclosed in U.S. Pat. No. 5,516,958 to Schaerfl, Jr. et al., which is hereby incorporated by reference for all purposes.

The olefin monomers can also contain minor amounts of up to about 50 mole %, and usually less than 25 mole %, of internal olefins and vinylidene olefins.

Alcohol Promoter

By "alcohol promoter," we mean an organic compound having at least one hydroxyl group (containing an —OH unit). Preferably, the alcohol promoter is an alkyl mono-alcohol, but alkyl diols could work. Most preferably, the alcohol promoter is a straight-chain mono-alcohol having from four to twelve carbon atoms.

Oligomerization Reaction

In the first step, a catalyst complex is formed of a boron trifluoride catalyst and at least one alcohol promoter in the absence of olefinic monomer. Preferably, this complex is formed in situ in the reactor where the oligomerization step will take place.

In the second step, a $C_{4-16}$ olefinic monomer is oligomerized by contacting the olefinic monomer with the catalyst complex, under boron trifluoride pressure, to produce an oligomer product.

The promoter can be used in minor, yet effective amounts. In general, boron trifluoride is used in molar excess to the amount of promoter. This can be accomplished by using a closed reactor and maintaining a positive boron trifluoride pressure over the reaction mixture. The olefinic monomer is contacted with the catalyst:promoter complex.

The reaction can be carried out in a batch or continuous process at temperatures of about −20° to 200° C. and pressures ranging from atmospheric up to, for example, 1,000 psig. The reaction temperature will change the oligomer distribution, with increasing temperatures favoring the production of tetramers through heptamers. Preferred reaction temperatures and pressures are about 0° to 90° C. and 5 to 100 psig.

When a desired oligomer distribution is reached in the batch mode, the reaction is terminated by venting off excess boron trifluoride gas and purging with nitrogen gas to replace all boron trifluoride gaseous residue. The reaction product, unreacted monomer, and boron trifluoride-promoter complex residue are removed from the reactor for further processing. In the continuous mode the dissolved boron trifluoride may be degassed from the reactor effluent. The boron trifluoride-promoter complex may be separated by settling or coalescing from the reaction product.

The crude reactor product is then washed with an aqueous caustic solution and followed by one or more water washes to ensure neutralization.

The oligomer mixture from the reaction contains minor amounts of monomer, dimer, and trimer, which can be removed by distillation. The monomer has been found to contain appreciable amounts of less reactive, isomerized material.

The product mixture can be further separated by distillation to provide one or more product fractions having the desired viscosities for use in various lubricant applications such as dielectric fluids, heat transfer fluids, gear oils and crankcase lubricants.

The oligomer product can be hydrogenated by conventional methods to increase the oxidation stability of the product. Supported nickel catalysts are useful. For example, nickel on a Kieselguhr support gives good results. Batch or continuous processes can be used. For example, the catalyst can be added to the liquid and stirred under hydrogen pressure or the liquid may be trickled through a fixed bed of the supported catalyst under hydrogen pressure. Hydrogen pressures of about 100 to 1,000 psig at temperatures of about 150° to 300° C. are especially useful. Preferably, the hydrogen pressure is from 400 to 1,000 psig and the maximum temperature is 200° C. to 300° C.

Oligomer Product

The oligomer product is that portion of the reaction product remaining after boron trifluoride, promoters, and unreacted monomer are removed. Preferably, the oligomer product has the following composition:

(a) less than 10 weight % dimer and trimer, (b) less than 75 weight % tetramer through heptamer, and (c) at least 15 weight % octamer and higher oligomers.

EXAMPLES

The invention will be further illustrated by following examples, which set forth particularly advantageous method embodiments. While the Examples are provided to illustrate the present invention, they are not intended to limit it.

Comparative Example A

The oligomerization reaction was carried out in an autoclave reactor equipped with a packless stirrer; and all wetted surfaces were made of 316 stainless steel. The reactor had an external electrical heater and an internal cooling coil for temperature control. The reactor was equipped with a dip tube, gas inlet, and vent valves, and a pressure relief rupture disc. Prior to the monomer charge, the reactor was cleaned, purged with nitrogen and pressure tested for leaks.

Eight hundred thirty grams of 1-decene was charge into the reactor. The promoter, 1-octanol, was added at 2 weight percentage feed charged or 2.1 mole %. The entire reactor content was under vacuum. Boron trifluoride gas was then sparged slowly and the contents agitated while temperature was controlled at 8° to 15°0 C. via a cooling coil to avoid reaction exotherm. Additional boron trifluoride was added as necessary to maintain a reactor pressure of 100 psig. The reaction was terminated after two hours by venting excess boron trifluoride gas and purging with nitrogen. The reaction product was then washed with a 4 weight % aqueous sodium hydroxide solution followed by several water washes to ensure neutralization. The product was saved for further treatment such as hydrogenation and fractionation. The final product had a calculated $C_{20+}$ viscosity of 5.11 centistoke based on oligomer distribution.

Comparative Examples B and C

The purpose of Examples B and C is to demonstrate that, in a conventional batch process, increasing the concentration of promoter does not yield significantly heavier oligomer distribution or 100° C. viscosity values. The procedure in Comparative Example A was followed except that the weight % of promoter to monomer was kept at 1.0% and 10.0%, respectively. After 15 minutes, 340 mls. of decene feed with the same respective promoter to feed weight % was introduced over a 45 minute period. Total run time was 75 minutes.

Examples 1 and 2

Examples 1 and 2 were run under the same pressure and temperature conditions as in Comparative Examples A, B, and C. In Example 1, the initial reactor charge was 0.5 moles 1-octanol with 35 grams of heptane and the feed consisted of 1-decene and 1 weight % 1-octanol. A vacuum was drawn on the reactor. Boron trifluoride was introduced to the reactor under agitation at 100 psi. Immediately, thereafter the 1-decene feed containing 1 weight % 1-octanol was introduced at approximately 440 mls per hour. The total feed introduced to the reactor was 4105 mls and the run time was 540 minutes.

The same procedure as in Example 1 was followed in Example 2 except 0.75 moles 1-octanol and 41 grams heptane were charged to the reactor. The total run time was 230 minutes and 2010 mls of 1-decene with 1 weight % 1-octanol was introduced to the reactor. The results of Examples A, B, C, 1, and 2 are summarized in Table 1. The calculated product viscosity values at 100° C. and the degree to which oligomerization ($C_{80+}$) is enhanced by the present invention is readily apparent.

TABLE 1

| Ex | Mole Promoter in Charge | Mole Monomer in Charge | Molar % Promoter in Feed | Mole % Total Promoter to Total Feed | % $C_{20}$–$C_{30}$ | % $C_{40}$–$C_{70}$ | %$C_{80+}$ | $C_{20+}$ Calculated viscosity |
|---|---|---|---|---|---|---|---|---|
| A | 0.13 | 5.93 | no feed | 1.5 | 50.69 | 46.95 | 2.36 | 5.11 |
| B | 0.064 | 5.93 | 1.1 | 1.1 | 48.9 | 51.1 | 0 | 5.18 |
| C | 0.64 | 5.93 | 10.7 | 10.7 | 44.9 | 55.1 | 0 | 5.88 |
| 1 | 0.5 | 0 | 1.1 | 3.4 | 9.8 | 71.6 | 18.6 | 11.76 |
| 2 | 0.75 | 0 | 1.1 | 8.5 | 7.4 | 50.9 | 41.7 | 15.79 |

The product viscosity difference between Examples B and C is not significant. Further increasing the molar % promoter does not yield benefits of increased product viscosity and heavier oligomer distribution. However, these examples show, that using the present invention in the presence of a preformed catalyst complex, using the same promoter and under controlled feed rates, consistently yields 4 to 10 centistoke greater product viscosity.

Examples 3 Through 8

Examples 3 through 8 were run following the present invention procedure under the same pressure, temperature, and feed rate conditions as Examples 1 and 2, but vary the alcohol promoter molecular weight. The results from Examples 3 through 8 are summarized in Table 2. The prior art teaches that the use of higher molecular weight alcohols favors an increase in the degree of oligomerization. This observation is confirmed and maintained in the present invention. Overall, the decanol runs yield 2 to 4 centistoke higher viscosities than hexanol.

The inclusion of these results demonstrates the product viscosity limitations of the traditional methodology of admixing the co-catalyst and feed streams simultaneously.

TABLE 2

| Ex | Type of Promoter | Mole Promoter to Charge | Molar % Promoter of Feed | Mole % Total Promoter to Total Feed | % $C_{20}$–$C_{30}$ | % $C_{40}$–$C_{70}$ | % $C_{80+}$ | $C_{20+}$ Calculated viscosity |
|---|---|---|---|---|---|---|---|---|
| 3 | Hexanol | 0.25 | 5.5 | 9.70 | 6.32 | 71.7 | 22.4 | 13.59 |
| 4 | Hexanol | 0.5 | 1.4 | 9.60 | 5.00 | 62.5 | 32.5 | 15.58 |
| 5 | Hexanol | 1.0 | 1.5 | 21.50 | 7.53 | 54.4 | 37.8 | 16.61 |
| 6 | Decanol | 6.25 | 0.72 | 8.80 | 7.00 | 52.6 | 40.4 | 15.15 |
| 7 | Decanol | 0.5 | 0.72 | 18.20 | 7.80 | 45.2 | 47.0 | 19.48 |
| 8 | Decanol | 1.0 | 0.72 | 35.70 | 7.60 | 37.2 | 55.2 | 20.64 |

In summary, conventional methods for the oligomerization of an alpha olefin monomer feed, such as decene or dodecene, with a promoter complex yield product viscosities generally under 10 cSt. Higher viscosities are not achievable without utilizing significantly longer reaction times, slower feed rates, and or adding modifiers to alter the original reaction product. More active or aggressive Freidel-Crafts catalysts such as $AlCl_3$ or metal alkyls are generally used in order to produce a 1-decene product with viscosities greater than 10 centistoke. It has been demonstrated that significantly higher 100° C. product viscosities can be attained by the present invention.

Examples 9 Through 12

Contemporaneous with our novel process was the recognition that alpha-omega dienes (diolefins) when used as co-monomers, or second stage feeds, would change the resident oligomer distribution yielding a much heavier product weight and viscosity.

Examples 9 through 12 follow the present invention procedure. The pressure, temperature, and feed rates are the same as those in Examples 1 and 2. The feed contains 1-decene, the indicated molar % of a diolefin co-monomer, and a promoter. 1-Octanol promoter was used in all examples, except for Example 12, which used both 1-heptanol and 1-tetradecanol in two feeds of 1,9-decadiene co-monomer, where the first feed contained a 2:1 ratio of olefin to diolefin and the second stage feed contained a 1:1 ratio of olefin to diolefin. The amount of promoter in the initial charge was 0.5 mole, except for Example 12, where it was 0.4 mole. The molar % of promoter in feed was 1.1, except for Example 12, where it was 1.2. The total mole % of promoter to feed was 8.1, except for Example 12, where it was 21.0. The results are summarized in Table 3.

TABLE 3

| Ex. | Diene | Molar % Diene | % $C_{20-30}$ | % $C_{40-70}$ | % $C_{80+}$ | 100° C. viscosity cSt $C_{20+}$ | VI |
|---|---|---|---|---|---|---|---|
| 9 | $C_{10}$ | 12.1 | 10.9 | 45.50 | 43.60 | 19.30 | 135 |
| 10 | $C_{10}$ | 27.4 | 13.6 | 34.10 | 52.30 | 27.60 | 140 |
| 11 | $C_{10}$ | 47.4 | 12.7 | 24.30 | 63.00 | 54.20 | 164 |
| 12 | $C_{10}$ | 50.2 | 7.9 | 25.70 | 66.40 | 162.5 | 298 |

While the present invention has been described with reference to specific embodiments, this application is intended to cover those various changes and substitutions that may be made by those skilled in the art without departing from the spirit and scope of the appended claims.

What is claimed is:

1. A process for producing a synthetic lubricant material having a 100° C. viscosity of not less than 10 centistokes comprising:

(a) forming a catalyst complex of a boron trifluoride catalyst and at least one alcohol promoter in the absence of olefinic monomer; and (b) oligomerizing a $C_{4-16}$ olefinic monomer by adding the olefinic monomer to a reaction vessel containing the catalyst complex, under positive boron trifluoride pressure relative to the olefinic monomer, to produce an oligomer product, wherein said olefinic monomer comprises at least 50 weight % $C_{8-16}$ olefinic monomer;

and wherein said $C_{4-16}$ olefinic monomer comprises an alpha-omega diolefin.

2. A process according to claim 1 wherein said alpha-omega diolefin constitutes from 2 to 50 weight % of the $C_{4-6}$ olefinic monomer.

3. A process according to claim 1 wherein said alcohol promoter comprises a straight-chain mono-alcohol having from four to twelve carbon atoms.

4. A process according to claim 1 wherein said oligomer product has the following composition:

(a) less than 10 weight % dimer and trimer, (b) less than 75 weight % tetramer through heptamer, and (c) at least 15 weight % octamer and higher oligomers.

* * * * *